US005575253A

United States Patent [19]

Lambert et al.

[11] Patent Number: 5,575,253

[45] Date of Patent: Nov. 19, 1996

[54] FUEL PUMPING APPARATUS

[75] Inventors: Malcolm D. D. Lambert; Adam M. Cox, both of London; Colin T. Timms, Harrow Weald, all of England

[73] Assignee: Lucas Industries Public Limited Company, Solihull, England

[21] Appl. No.: 623,296

[22] Filed: Mar. 28, 1996

[30] Foreign Application Priority Data

Apr. 6, 1995 [GB] United Kingdom ..... 9507115

[51] Int. Cl.[6] ..... F02M 37/04

[52] U.S. Cl. ..... 123/300; 123/446

[58] Field of Search ..... 123/299, 300, 123/446, 447, 500, 501

[56] References Cited

U.S. PATENT DOCUMENTS

| | | | |
|---|---|---|---|
| 4,224,903 | 9/1980 | Mowbray | 123/300 |
| 4,259,040 | 3/1981 | Scheying | 123/300 |
| 4,520,774 | 6/1985 | Sitter | 123/300 |
| 4,590,904 | 5/1986 | Wannenwetsuh | 123/300 |
| 4,671,232 | 6/1987 | Stumpp | 123/300 |
| 4,711,209 | 12/1987 | Henkel | 123/300 |
| 5,090,378 | 2/1992 | Gonzalez | 123/300 |
| 5,195,487 | 3/1993 | Zurner | 128/300 |

FOREIGN PATENT DOCUMENTS

| | | | |
|---|---|---|---|
| 810456 | 3/1959 | United Kingdom | 123/300 |

*Primary Examiner*—Carl S. Miller

*Attorney, Agent, or Firm*—Jacobson, Price, Holman & Stern, PLLC

[57] ABSTRACT

A fuel pumping apparatus comprises a body defining a first bore within which a pumping plunger is reciprocable. The first bore communicates with a spill valve. A pilot piston is moveable within a pilot bore under the influence of the pressure within the first bore. A piston member is slidable within a blind drilling provided in the pilot piston such that upon movement of the pilot piston, fuel within the drilling is pressurised to a higher pressure than fuel within the first bore. Passage means connects the drilling with a fuel injection nozzle.

8 Claims, 4 Drawing Sheets

FUEL PUMPING APPARATUS

This invention relates to a fuel pumping apparatus comprising a high pressure pump including an engine cam actuated pumping plunger slidable within a bore formed in a body, a spill valve which when open allows fuel to spill from the bore during inward movement of the plunger and a fuel injection nozzle mounted on the body and which receives fuel from the bore when during the inward movement of the plunger, the spill valve is closed.

Such apparatus is known in the art as a pump/injector and is particularly useful for supplying fuel to an engine at very high pressure. The spill valve can be operated by an electromagnetic actuator under the control of an electronic engine management system. It is well known that the operation of a compression ignition engine can be improved by delivering a small quantity of the total fuel charge in advance of the main quantity of fuel. This can be achieved by closing the spill valve to produce delivery of fuel, opening the spill valve to terminate delivery of the pilot quantity of fuel and then reclosing the spill valve for the main delivery of fuel. The problem with this arrangement is that the spill valve takes a finite time to move from the open to the closed position and vice versa and this makes the control of the spill valve difficult.

The object of the invention is to provide an apparatus of the kind specified in an improved form.

According to the invention an apparatus of the kind specified comprises a pilot piston movable in a pilot bore, first resilient means acting on the pilot piston to bias the pilot piston into engagement with a first stop, said pilot piston being movable away from said first stop into engagement with a second stop by fuel under pressure applied to the pilot piston from said first mentioned bore, a piston member slidable within a blind drilling formed in the pilot piston, a second resilient means acting between the piston and piston member, said piston member engaging said second stop whereby during movement of the pilot piston by the fuel under pressure in the first mentioned bore the fuel in the drilling will be pressurised to a higher value than the pressure in the bore, and passage means connecting the blind drilling with said fuel injection nozzle.

Figure 1:
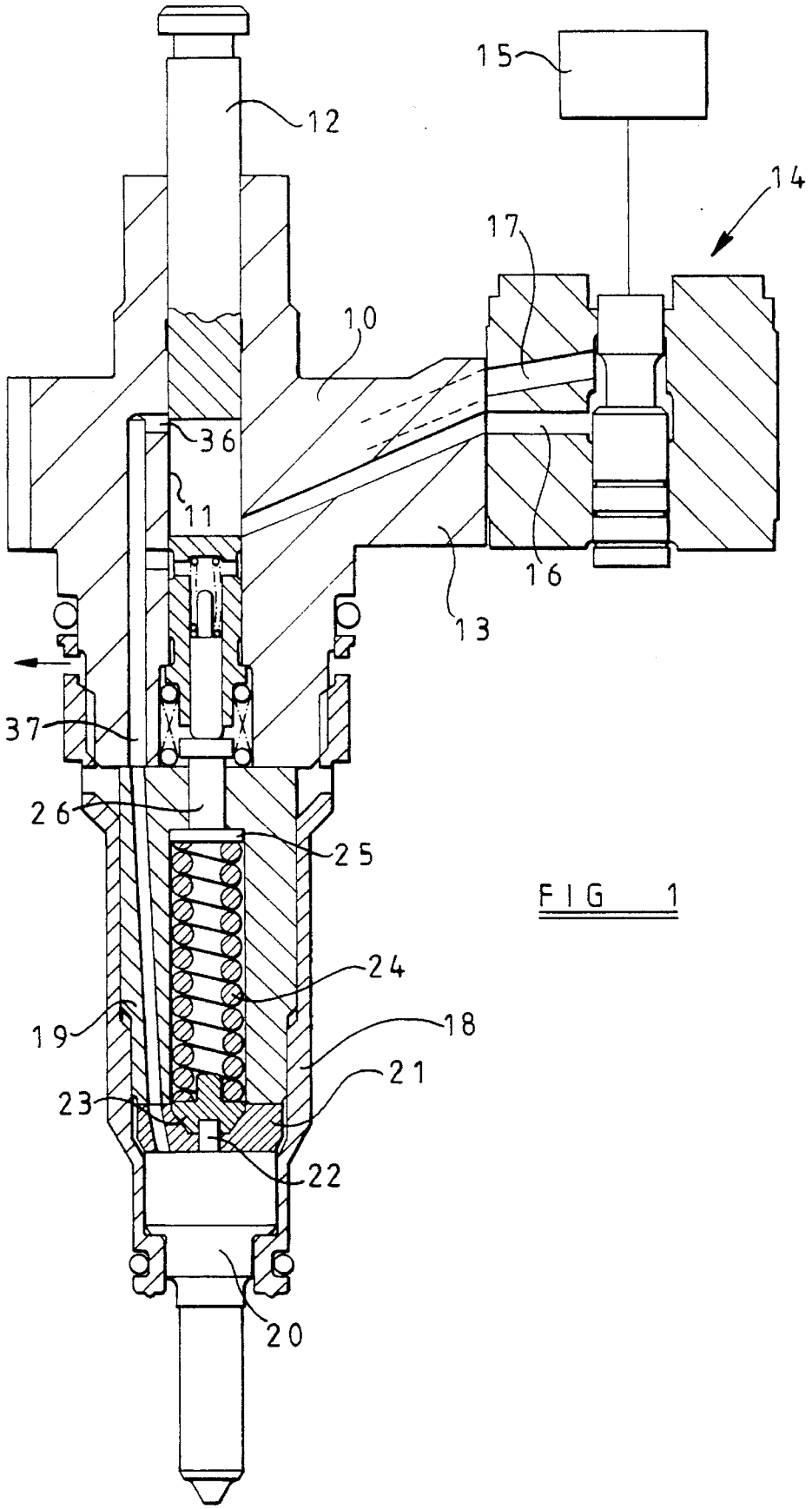
Figure 2:
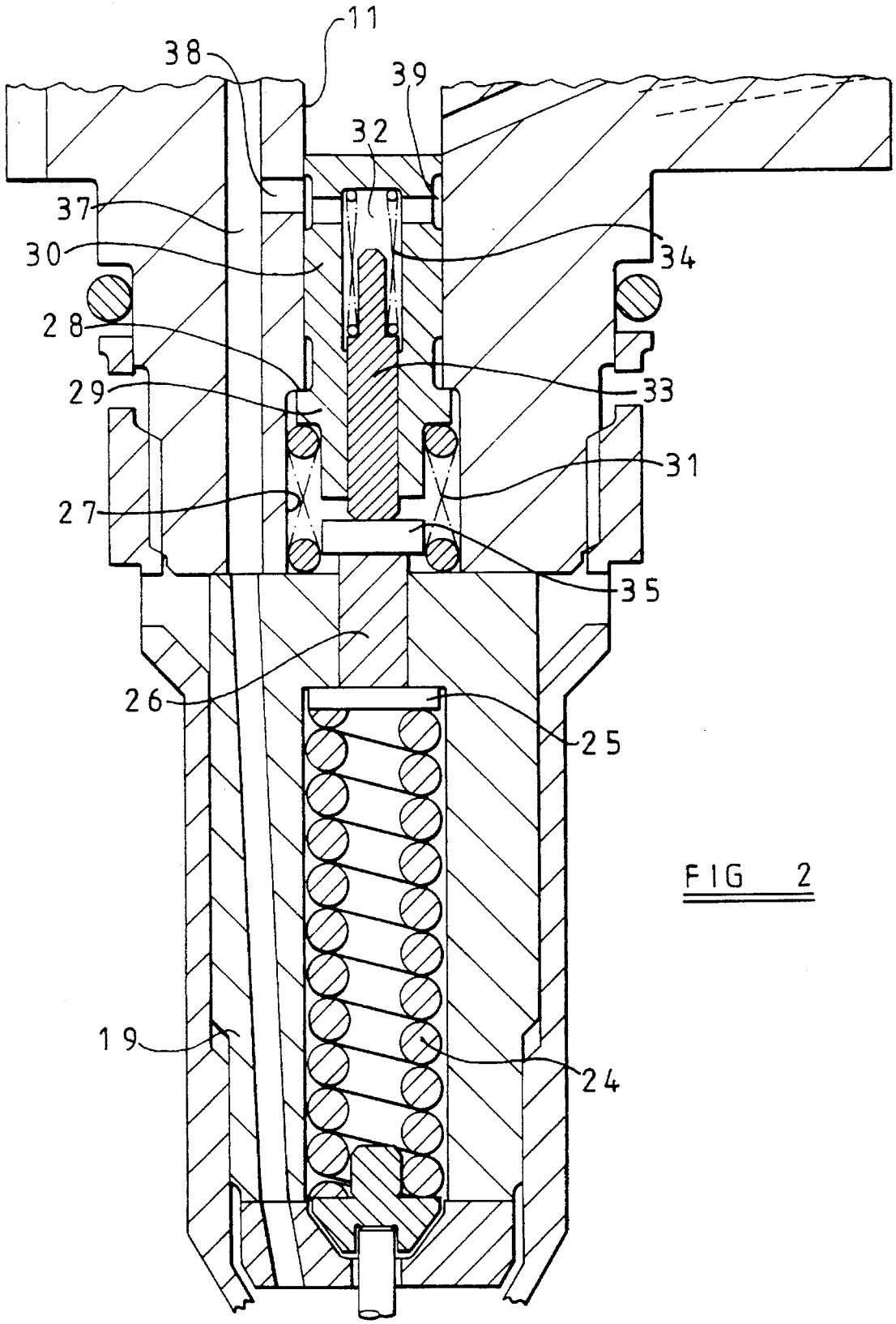
Figure 3:
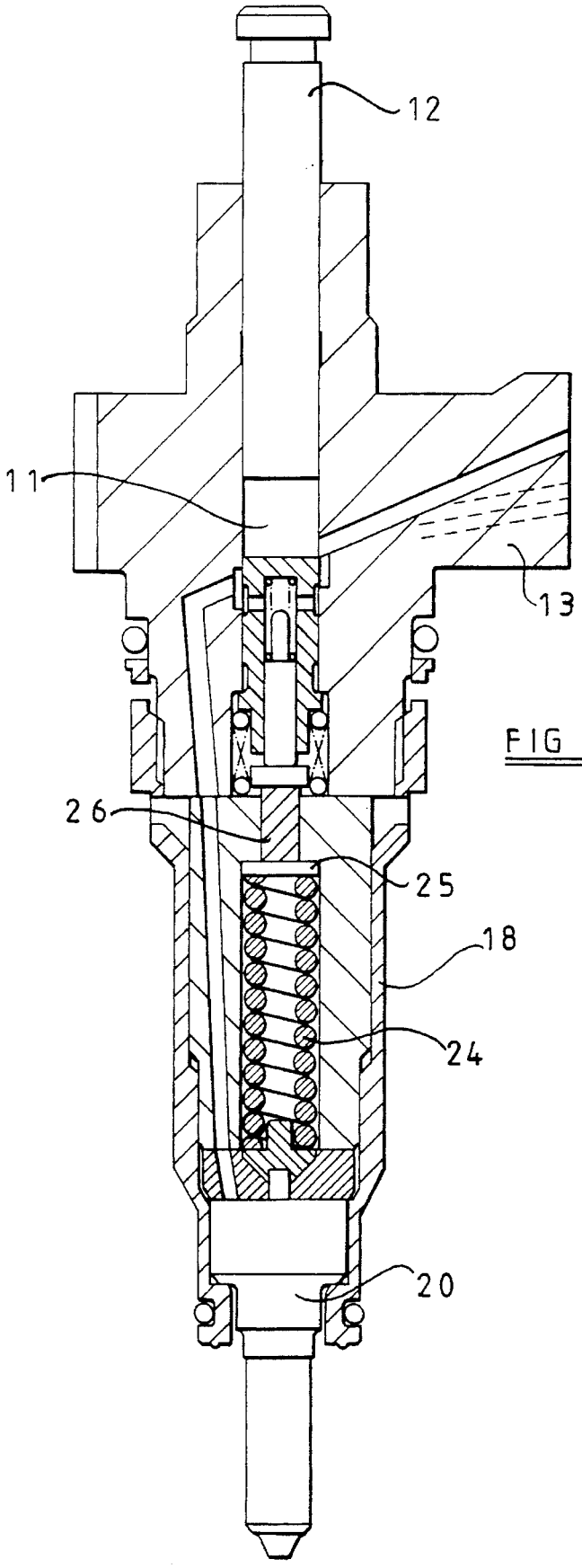
Figure 4:
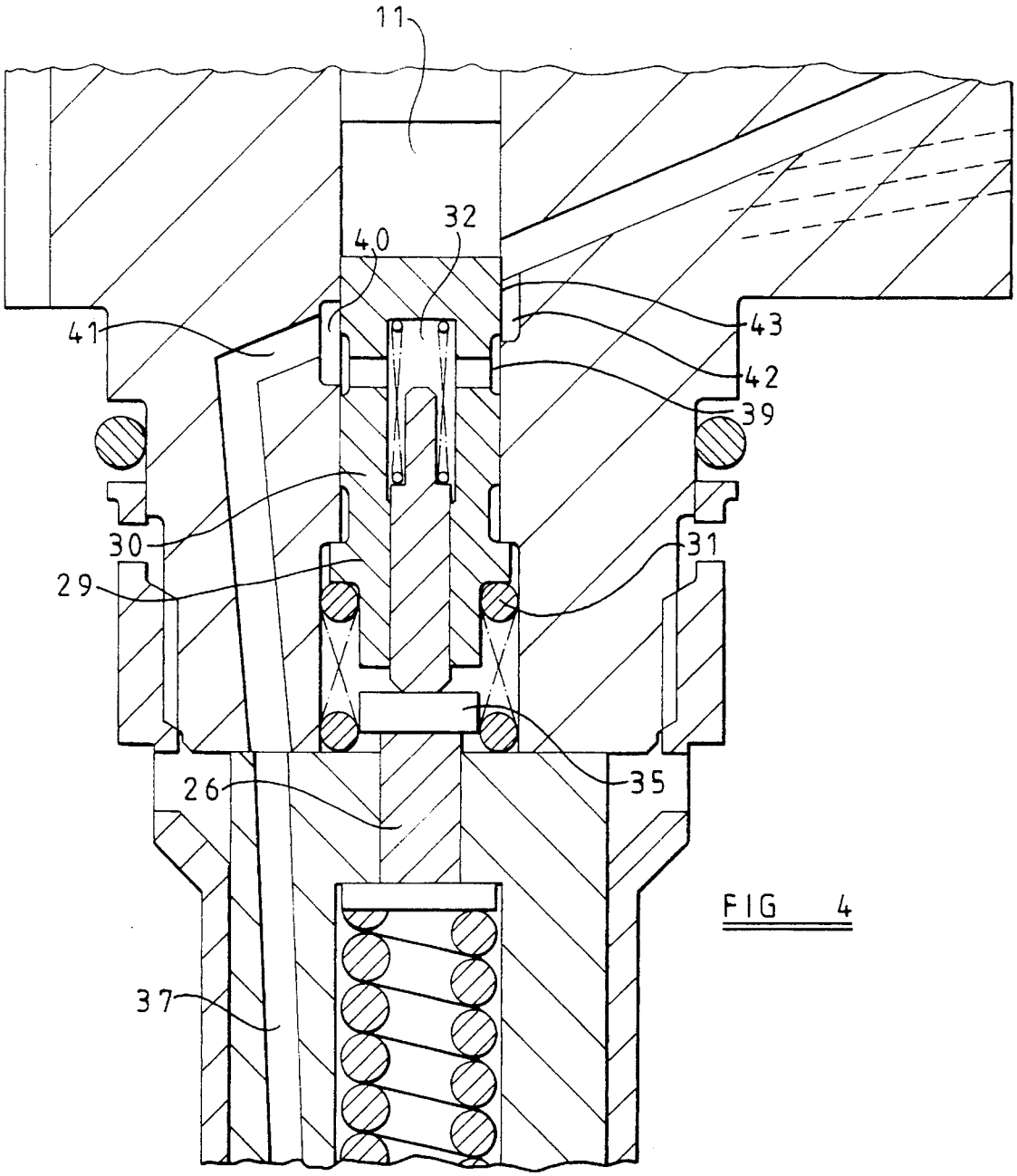

In the accompanying drawings:

FIG. 1 is a sectional side elevation of one example of a pump/injector in accordance with the invention, FIG. 2 is a view to an enlarged scale of part of the nozzle seen in FIG. 1, and FIGS. 3 and 4 are views showing a modification.

Referring to FIGS. 1 and 2, there is provided a main body 10 through which extends a cylindrical bore 11 and extending from one end of the bore is a pumping plunger 12 which at its outer end is adapted to receive a spring abutment (not shown). Interposed between the spring abutment and the body is a coiled compression spring (not shown) which biases the plunger outwardly to its outermost position as seen in FIG. 1. The plunger is movable inwardly by the action of an engine driven cam.

The body 10 is provided with a lateral extension 13 upon which is mounted a spill control valve 14 which includes a valve member which is spring biased to the open position. The valve member is moved to the closed position by energising an electromagnetic actuator 15 and in the closed position flow of fuel along a passage 16 connected to the bore 11 is prevented. When the spill valve is open fuel can flow from the passage 16 to a further passage 17 which communicates with a drain.

Secured to the body 10 by means of a cap nut 18 is an assembly comprising a cylindrical spacer member 19, a fuel injection nozzle 20 and a distance piece 21 which is positioned between the body of the nozzle and the spacer member. The fuel injection nozzle is of the inwardly opening type and its valve member has an extension 22 upon which is mounted a spring abutment 23, the extension and spring abutment being housed with clearance in a drilling and a recess respectively formed in the distance piece. The abutment is engaged by one end of a coiled compression spring 24 which is housed within a cylindrical chamber formed in the spacer member 19 and the other end of the spring engages a shim 25 which itself is in engagement with an end wall of the chamber. This end wall is pierced by a drilling the wall of which serves to guide the movement of a peg 26 which projects beyond the adjacent end of the spacer member into an enlarged end portion 27 of the bore 11.

The junction of the bore 11 and its enlarged portion 27 defines a step 28 which is engageable by a flange 29 formed on a pilot piston 30 slidable in the bore 11. The flange is urged into engagement with the step 28 by means of a coiled compression spring 31 interposed between the flange and the adjacent end surface of the spacer member 19. The pilot piston is formed with a blind drilling 32 which extends inwardly from the end of the piston remote from the pumping plunger and slidable within the drilling is a piston member 33, the piston member being lightly biased out of the drilling by a light spring 34. The action of the light spring is to urge the piston member into engagement with a further shim 35 which is interposed between the piston member and the peg 26.

As previously mentioned the passage 16 communicates with the bore 11 and it does so at a position adjacent the head of the pilot piston 30. Also communicating with the bore is a first port 36 which is just uncovered by the pumping plunger 12 at the outermost position of its travel. This port by way of a passage 37 which has a first portion in the body, a second portion in the spacer member 19 and a third portion in the distance piece communicates with a fuel inlet passage of the injection nozzle 20. A second port 38 communicates with the bore 11 and it is positioned so that in the rest position it is covered by the pilot piston 30. The port 38 is also in communication with the passage 37. Moreover, the pilot piston 30 is provided with a circumferential groove 39 adjacent its end and this groove is in constant communication with the blind end of the drilling 32.

In operation, assuming that the bore 11 is full of fuel and the spill valve 14 is open, as the plunger is moved inwardly by the cam, fuel will be displaced from the bore and will flow to drain by way of the spill valve. If the spill valve is closed the fuel pressure in the bore 11 will increase and when the pressure in the bore 11 has risen to a sufficiently high value, the pilot piston 30 will move against the action of the springs 31 and 34. Such movement pressurises the fuel in the blind end of the drilling 32, the passage 37 and the fuel injection nozzle. When the fuel pressure rises to a sufficiently high value termed the lower nozzle opening pressure, the valve member of the fuel injection nozzle lifts to allow fuel flow to the engine. The lower nozzle opening pressure is set by the shim 25, and the force exerted by the spring 24 is sufficiently great as to prevent movement of the shim 35 and peg 26 by the force generated by the fuel pressure acting upon the piston member 33.

The pilot piston continues to move and fuel is displaced from the drilling 32 until the pilot piston engages the shim 35. At this point pilot delivery of fuel to the engine ceases. However, with an increase of pressure in the bore 11, the pilot piston 30 together with the shim 35 and the peg 26 move against the combined action of the springs 24 and 31 until the shim 35 engages the adjacent end surface of the spacer. This has the effect of raising the nozzle opening pressure of the injection nozzle. Such movement also connects the port 38 to the bore 11 and with a further increase in the pressure in the bore 11 to the higher nozzle opening pressure, the valve member of the nozzle is lifted to allow the main quantity of fuel to be supplied to the engine, such flow of fuel continuing so long as the pumping plunger is being moved inwardly by the cam, until the spill valve 14 is opened.

When the spill valve is opened and the pumping plunger is moving inwardly the pressure in the bore 11 will fall and the nozzle valve member will close under the action of the spring 24 and the fuel which continues to be displaced by the pumping plunger will flow through the spill valve to drain. The reduction in pressure within the bore 11 allows the pilot piston to be returned to the position shown. The initial return movement is effected by both springs 24 and 31 but when the shim 25 engages the end of the spring chamber the further return motion is effected by the springs 31 and 34 as the pressure in the bore 11 decreases further. The relative movement of the pilot piston 30 and the piston member 33 creates a depression in the blind end of the drilling 32 and this is filled with fuel when the port 36 is uncovered by the pumping plunger 12.

The strength of the spring 31 must be sufficient to prevent movement of the pilot piston 30 except when the spill valve 14 is closed. When the spill valve is open the fuel which is displaced by the pumping plunger flows through the spill valve to drain but even so the fuel within the bore 11 will be pressurised and this pressure is applied to the pilot piston. The pressure which is generated increases with speed.

The tendency for movement of the pilot piston to occur is more acute when the port 36 is open since in this situation the pressure in the drilling 32 is the same as in the bore 11. It is therefore only the force exerted by the spring 31 and to a lesser extent the spring 34, which holds the pilot piston against movement. If movement of the pilot piston did take place the result would be a reduction in the pilot quantity of fuel supplied and hence a reduction in the total quantity of fuel supplied for a given closed period of the spill valve. Once the port 36 is closed the drilling is locked off to the injection nozzle and any slight movement of the pilot piston whilst undesirable, would build up the fuel pressure in the drilling 32 to assist the action of the springs 31 and 34 to prevent further movement of the pilot piston until the spill valve is closed.

During delivery of the main quantity of fuel to the engine the pressure in the bore 11 is substantial and the force exerted upon the pilot piston is high. The annular end area of the pilot piston and the corresponding area of the shim 35 is made sufficiently large to withstand the forces.

As previously mentioned the shim 25 is selected to provide the desired lower nozzle opening pressure and the amount by which the peg 26 projects beyond the end of the spacer member 19 sets the difference between the lower and upper nozzle opening pressures. The distance between the shim 35 and the end of the pilot piston 30 when the flange 29 of the pilot piston is in engagement with the step 28 determines the pilot fuel quantity and can be adjusted by varying the thickness of the shim or grinding the end of the pilot piston or both. In this respect it is important to ensure that whilst there is relative movement between the pilot piston and the piston member, the groove 39 is in communication with the port 38 and that the latter is only uncovered to the bore 11 after such relative movement has ceased and before the shim 35 engages the end surface of the spacer 19.

In due course, the bore 11 is refilled with fuel from a suitable source, for example through the spill valve in a conventional manner.

A modification of the apparatus is seen in FIGS. 3 and 4 in which like reference numerals to those used in FIGS. 1 and 2 are used where possible.

Referring to FIGS. 3 and 4 it will be seen that the ports 36 and 38 are no longer present but instead there is formed in the wall of the bore 11 a recess 40 from which extends a short passage 41 which connects with the passage 37 leading to the nozzle. Conveniently the passage 41 is formed at the same time as the passage which connects the bore 11 with the spill valve. The recess 40 is produced by E.D.M.

The sealing land 43 between the groove 39 and the end of the pilot piston 30 facing the pumping plunger has an increased axial length. Moreover, a further recess 42 is provided in the wall of the bore 11 and this recess is also produced by E.D.M. The recess 42 overlaps the groove 39 by a small amount and the extent of the overlap is tightly controlled.

In operation, when the spill valve is closed the pressure in the bore 11 increases and the pilot piston moves against the action of the springs until the sealing land 43 closes off the lower edge of the recess 42. The fuel in the drilling 32 is then pressurised and is supplied to the nozzle by way of the groove 39 and the recess 40. This flow of fuel continues until the pilot piston engages the shim 35. Following the engagement of the pilot piston with the shim the sealing land uncovers the recess 40 and the further operation is then as described with reference to FIGS. 1 and 2. When the spill valve is opened the pilot piston and the valve member are returned to the position shown and fuel can flow into the drilling 32 by way of the groove 39 when the latter is uncovered to the recess.

It is anticipated that in both examples the pilot piston will be held by the springs in engagement with the step 28 until closure of the spill valve to achieve delivery of fuel. If however some movement of the pilot piston does take place only a predetermined quantity of fuel will be lost in the case of the example shown in FIGS. 3 and 4 whereas in the case of the example shown in FIGS. 1 and 2 the quantity of fuel lost will be dependent upon the stroke of the pumping plunger before the port 36 is covered and this will be susceptible to tolerances external to the pump/injector.

We claim:

1. A fuel pumping apparatus comprising a high pressure pump including an engine cam actuated pumping plunger slidable within a first bore formed in a body, a spill valve which when open allows fuel to spill from the first bore during inward movement of the plunger and a fuel injection nozzle mounted on the body and which receives fuel from the first bore when during the inward movement of the plunger the spill valve is closed, a pilot piston movable in a pilot bore, first resilient means acting on the pilot piston to bias the pilot piston into engagement with a first stop, said pilot piston being movable away from said first stop into engagement with a second stop by fuel under pressure applied to the pilot piston from said first bore, a piston member slidable within a blind drilling formed in the pilot piston, a second resilient means acting between the piston and piston member, said piston member engaging said second stop whereby during movement of the pilot piston by the fuel under pressure in the first bore, fuel in the drilling is pressurised to a higher value than the pressure in the bore, and passage means connecting the drilling with said fuel injection nozzle.

2. An apparatus as claimed in claim 1, wherein said second stop is associated with the fuel injection nozzle, the second stop being moveable to adjust the level of the fuel pressure which must be applied to the fuel injection nozzle in order to commence injection.

3. An apparatus as claimed in claim 2, wherein the fuel injection nozzle includes a valve member biased into engagement with a seating by a spring, the second stop being moveable to compress the spring, in use.

4. An apparatus as claimed in claim 1, wherein the passage means is arranged to communicate with the first bore once the pilot piston has moved beyond a predetermined position.

5. An apparatus as claimed in claim 1, further comprising supply means for supplying fuel to the blind drilling.

6. An apparatus as claimed in claim 5, wherein the supply means comprises a port in communication with the passage means, the port being arranged to permit communication between the passage means and the first bore when the pumping plunger is in a retracted position, movement of the plunger away from the retracted position closing the port.

7. An apparatus as claimed in claim 5, wherein the supply means comprises a recess provided in the body and communicating with the first bore, the recess being located in a part of the body such that when the pilot piston engages the first stop, fuel from the first bore is permitted to flow through the recess to the blind drilling, movement of the pilot piston away from the first stop terminating such flow.

8. An apparatus as claimed in claim 1, wherein the pilot bore comprises part of the first bore.

* * * * *